US007600696B2

(12) United States Patent
Hotta

(10) Patent No.: US 7,600,696 B2
(45) Date of Patent: Oct. 13, 2009

(54) HOT WATER SUPPLY SYSTEM

(75) Inventor: Keisuke Hotta, Nagoya (JP)

(73) Assignee: Rinnai Corporation, Nagoya-Shi (JP)

( * ) Notice: Subject to any disclaimer, the term of this patent is extended or adjusted under 35 U.S.C. 154(b) by 973 days.

(21) Appl. No.: 11/029,491

(22) Filed: Jan. 6, 2005

(65) Prior Publication Data

US 2005/0205684 A1 Sep. 22, 2005

(30) Foreign Application Priority Data

Jan. 7, 2004 (JP) ..... 2004-001822

(51) Int. Cl.
*F22B 37/36* (2006.01)

(52) U.S. Cl. ..... 237/70; 122/494; 220/567.3

(58) Field of Classification Search ..... 122/19.2, 122/13.01; 432/34, 38, 237, 250, 56; 126/116 A, 126/110 R, 39 E, 39 BA; 237/70; 73/323, 73/328, 330; 68/210
See application file for complete search history.

(56) References Cited

U.S. PATENT DOCUMENTS 5,163,119 A * 11/1992 Windon ..... 392/449
6,499,439 B1 * 12/2002 Kohler et al. ..... 122/19.2

FOREIGN PATENT DOCUMENTS

JP 64-53858 U 4/1989

* cited by examiner

*Primary Examiner*—Steven B McAllister
*Assistant Examiner*—Robert E Thomas
(74) *Attorney, Agent, or Firm*—Birch, Stewart, Kolasch & Birch, LLP

(57) ABSTRACT

A hot water supply system having a hot water supply system body. An operation box is inserted into a window opened in a front panel of the hot water supply system body, and a box cover having an opening to which an operation unit in a front center region of the operation box is fitted is mounted onto a front surface of the operation box. The box cover overhangs to an outside of an outline of the operation box and has a size making it possible to cover a gap between the operation box and the window from the front. A dent sized to corresponding to a size of the box cover is formed on a portion of the front panel, which includes a spot where the window is opened, and a backside corner portion of an outer edge of the box cover enters into the dent portion.

3 Claims, 4 Drawing Sheets

HOT WATER SUPPLY SYSTEM

BACKGROUND OF THE INVENTION

1. Field of the Invention

The present invention relates to a hot water supply system in which an operation box for performing various setting operations such as a setting operation for hot water supply temperature is mounted onto a hot water supply system body.

2. Description of the Related Art

Heretofore, in this type of hot water supply system, a window is opened in a front panel of a hot water supply system body, and an operation box mounted onto the hot water supply system body is inserted into the window (for example, refer to Japanese Utility Model Laid-Open Publication No. Showa 64-53858 (published in 1989)). Here, one using, as the operation box, the same one as a remote controller for the hot water supply system is also known. This operation box (remote controller) is configured in a manner that a box body having an operation unit on a front center region thereof and a back cover are fastened together by screws. Moreover, onto a front surface of the operation box, a box cover having an opening to which the operation unit is fitted is mounted, so that the screws which fasten the box body and the back cover are adapted not to appear on the exterior of the operation box.

Incidentally, when the operation box is inserted into the window of the front panel as in the related art described above, it becomes necessary to form the window somewhat larger than an outline of the operation box in order that the operation box can be inserted into the window even if a shift occurs in a relative positional relationship between the front panel and the operation box. Accordingly, a gap occurs between the operation box and the window. Moreover, when a positional shift of the operation box with respect to the front panel occurs, the gap between the operation box and the window is not made uniform over the entire periphery of the operation box, thereby damaging the appearance of the hot water supply system.

SUMMARY OF THE INVENTION

In consideration of the above point, it is an object of the present invention to provide a hot water supply system capable of favorably maintaining an appearance thereof even if the positional shift of the operation box occurs.

In order to achieve the above-described object, the present invention is a hot water supply system, comprising a hot water supply system body, a window opened in a front panel of the hot water supply system body, an operation box mounted onto the hot water supply system body and inserted into the window, a box cover having an opening and mounted onto a front surface of the operation box, and an operation unit provided on a front center region of the operation box and fitted to the opening, wherein the box cover is formed to overhang to an outside of an outline of the operation box and to have a size with which it is possible to cover a gap between the operation box and the window from the front, and a dent portion with a size corresponding to a size of the box cover is formed on a portion of the front panel, the portion including a spot where the window is opened, and a backside corner portion of an outer edge of the box cover enters into the dent portion.

With the above-described configuration, even if a gap between a periphery of the operation box and the window becomes nonuniform owing to the positional shift of the operation box to the front panel, such a gap is covered with the box cover, does not appear on the exterior, and does not accordingly damage the appearance of the hot water supply system. Here, when the positional shift of the operation box to the front panel occurs, the box cover mounted onto the operation box positionally shifts, too. Moreover, owing to a positional shift of the operation box in the fore-and-aft direction, the gap between the front panel and the box cover sometimes varies. However, in the present invention, as described above, the backside corner portion of the outer edge of the box cover enters into the dent portion of the front panel. Accordingly, even when viewed from the vertical direction and the horizontal direction, the gap between the front panel and the box cover is invisible. Hence, the appearance can be favorably maintained.

When a step portion of an outer edge of the dent portion with respect to the portion of the front panel in the periphery of the dent portion is formed to create a reentrant from the front panel at a right angle, the outer edge (outline) of the dent portion is clearly seen. Moreover, when the gap between the periphery of the box cover and the outer edge of the dent portion becomes nonuniform owing to the positional shift caused by the positional shift of the operation box, such nonuniformity of the gap becomes conspicuous, and the appearance is damaged.

As opposed to the above, when the step portion of the outer edge of the dent portion with respect to the portion of the front panel in the periphery of the dent portion is formed into an inclined surface continuous to the portion of the front panel with a radially curved surface portion interposed therebetween, the outer edge (outline) of the dent portion cannot be clearly seen. Therefore, even if the gap between the periphery of the box cover and the outer edge of the dent portion becomes nonuniform, the nonuniformity of the gap is not very conspicuous.

Even if the step portion is formed into the inclined surface in the above-described manner, when the outer edge of the box cover shifts inward from the inclined surface, a bottom surface of the dent portion appears on the exterior, and the shift becomes conspicuous. In this case, if the backside corner portion of the outer edge of the box cover is made opposite to a middle portion of the inclined surface, then the bottom surface of the dent portion does not appear on the exterior even if the box cover positionally shifts to some extent, and the appearance can be favorably maintained.

Moreover, if the inclined surface is formed to be continuous to the bottom surface of the dent portion with a radially curved surface portion interposed therebetween, then a boundary between the bottom surface of the dent portion and the inclined surface cannot be clearly seen. Therefore, the curved surface portion is useful for preventing deterioration of the appearance in the case where the box cover positionally shifts to an extent where the bottom surface of the dent portion appears on the exterior.

DETAILED DESCRIPTION OF THE PREFERRED EMBODIMENT

Figure 1:
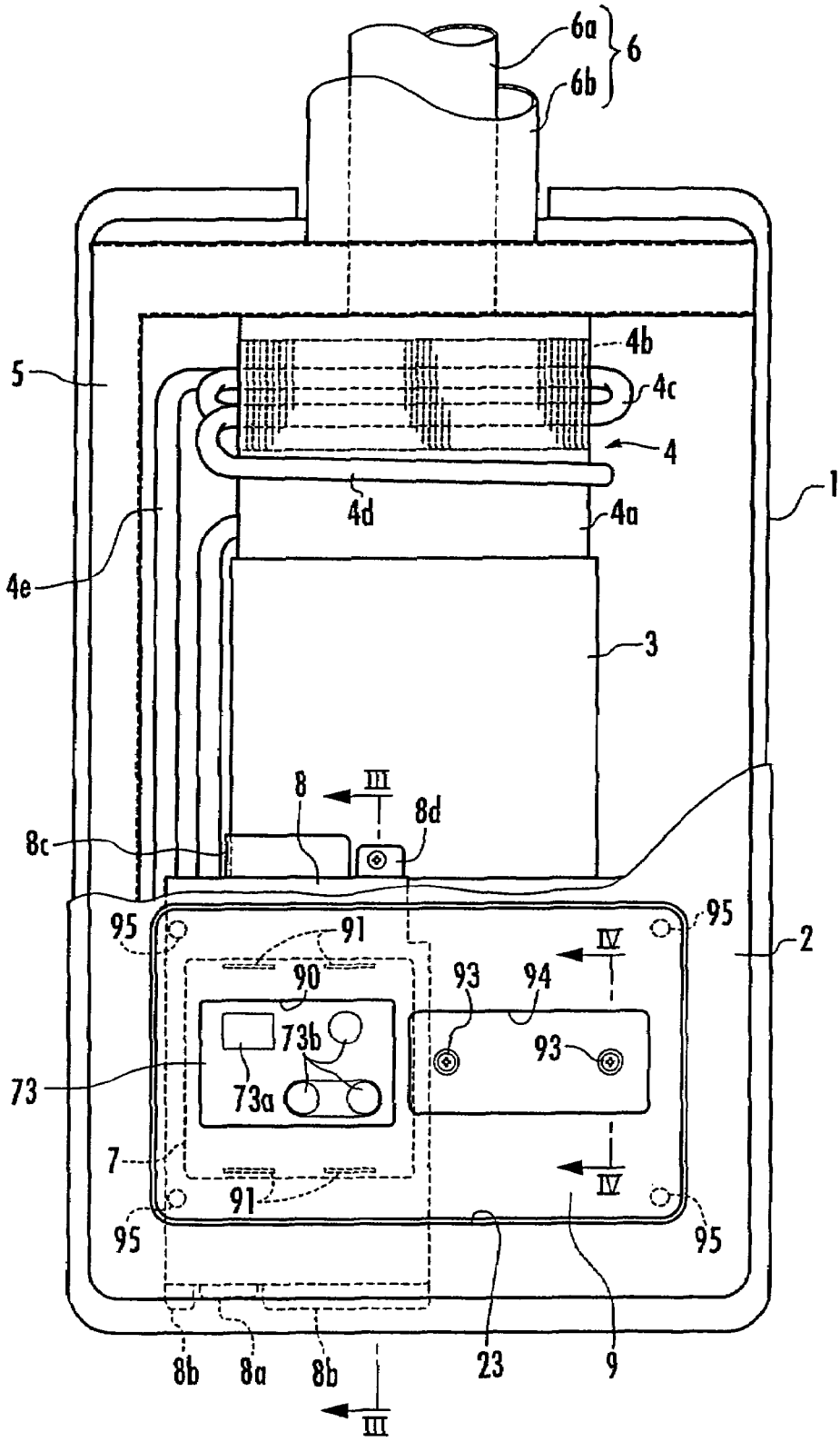
FIG. 1 is a front view showing a hot water supply system of an embodiment of the present invention, where a part of a front panel is cut away.

In a box-shaped hot water supply system body 1 in which a front is covered with a front panel 2, a hot water supply system shown in FIG. 1 includes a combustion housing 3 building a burner (not shown) therein, and a heat exchanger 4 connected continuously to an upper end of the combustion housing 3. The heat exchanger 4 is composed of a barrel unit 4*a* which forms a combustion chamber communicating with the combustion housing 3, and a heat-absorbing unit 4*b* which has a large number of fins mounted onto an upper portion of the barrel unit 4*a*. Moreover, a water supply pipe 4*d* is connected to an upstream end of a meander-shaped heat-absorbing pipe 4*c* provided in the heat-absorbing unit 4*b*, a hot water supply pipe 4*e* is connected to a downstream end thereof, and water is heated by exhaust gas of the burner in the heat-absorbing unit 4*b* while the water is passing from the water supply pipe 4*d* to the hot water supply pipe 4*e*.

Moreover, in the hot water supply system body 1, an air supply duct 5 extended from a position above the heat exchanger 4 toward a combustion fan (not shown) in a lower portion of the combustion housing 3 is provided. On an upper end of the hot water supply system body 1, there is provided a supply and exhaust pipe 6 with an in/out duplex formed of an inner pipe 6*a* communicating with the heat exchanger 4 and an outer pipe 6*b* communicating with the air supply duct 5. The exhaust gas of the burner is emitted from the heat exchanger 4 through the inner pipe 6*a* to the outside, and the outside air is supplied as a combustion air into the combustion housing 3 through the outer pipe 6*b*, the air supply duct 5 and the combustion fan.

Figure 2:
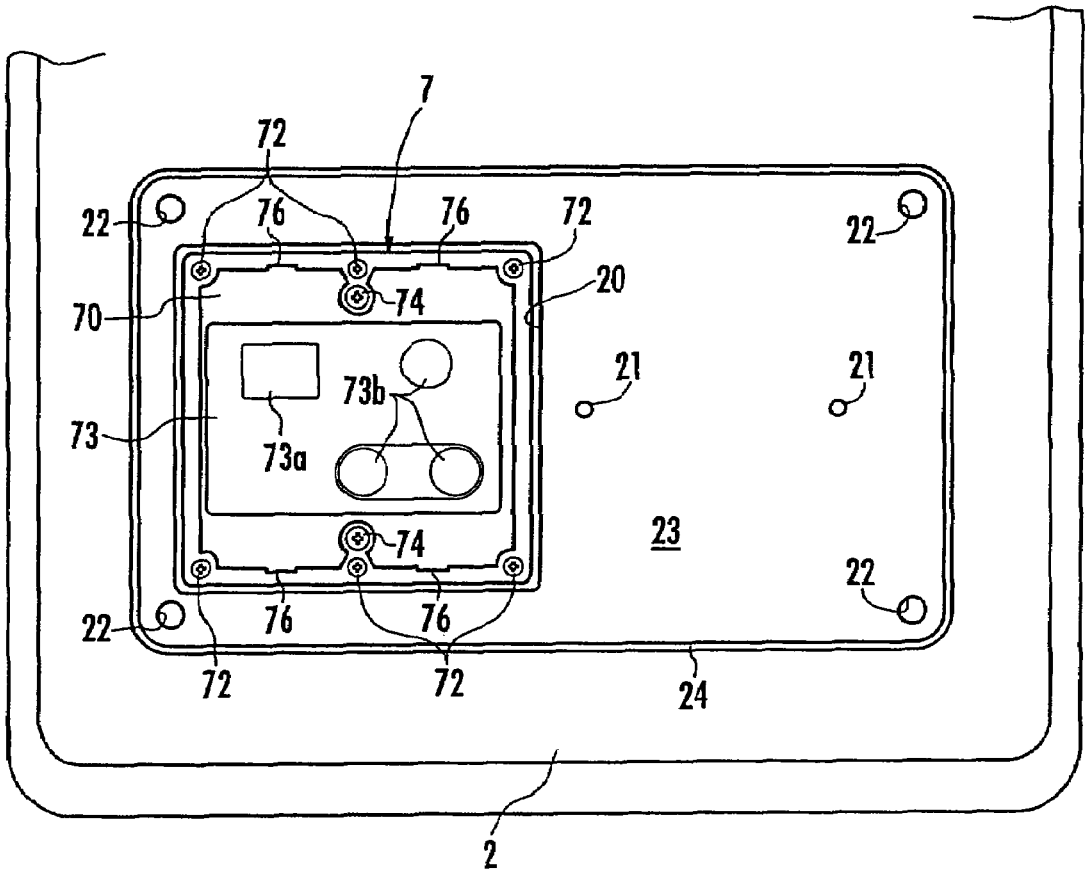
FIG. 2 is a front view of a main portion of the front panel of the hot water supply system of this embodiment in a state where a box cover is detached therefrom.
Figure 3:
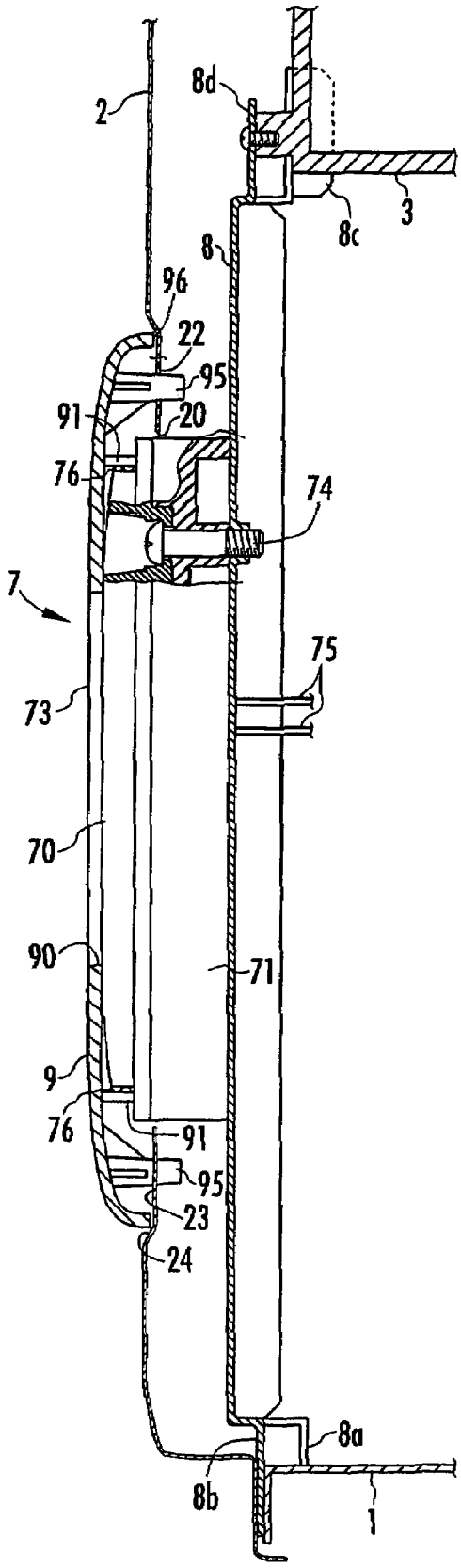
FIG. 3 is a cross-sectional view cut along a line III-III of FIG. 1.

Furthermore, onto the hot water supply system body 1, an operation box 7 which is the same as a remote controller for the hot water supply system is mounted. As shown in FIG. 2, in the front panel 2, a window 20 corresponding to the operation box 7 is opened, and the operation box 7 is inserted into the window 20. As shown in FIG. 2 and FIG. 3, the operation box 7 is assembled in a manner that a box body 70 and a back cover 71 are fastened together by screws 72. On a front center region of the box body 70, an operation unit 73 is provided, in which a display unit 73*a* and various operation buttons 73*b* are arranged. Moreover, onto the hot water supply system body 1, a mounting plate 8 for the operation box 7 is provided. The mounting plate 8 includes, on a lower end thereof, a piece 8*a* for positioning the mounting plate 8 in the vertical direction, which is made to strike on a lower end portion of the hot water supply system body 1, and a piece 8*b* for positioning the mounting plate 8 in the fore-and-aft direction, which is sandwiched between the hot water supply system body 1 and the front panel 2. Furthermore, the mounting plate 8 includes, on an upper end thereof, a piece 8*c* for positioning the mounting plate 8 in the horizontal direction, which abuts on a side face of the combustion housing 3, and a piece 8*d* for fixing the mounting plate 8, which is screwed on the combustion housing 3. Above and below the operation unit 73, the operation box 7 is fastened to the mounting plate 8 by screws 74. Note that the operation box 7 is connected to a controller (not shown) provided in the hot water supply system body 1 through lead wires 75 guided from a back surface of the operation box 7, and setting contents of various setting items such as hot water supply temperature set by operations of the operation buttons 73*b* are transmitted to the controller.

Moreover, in order to cover and conceal the above-described screws 72 and 74, a box cover 9 made of synthetic resin, which has an opening 90 to which the operation unit 73 is fitted, is mounted onto a front surface of the operation box 7. On a back surface of the box cover 9, claw pieces 91 corresponding to protruding portions 76 formed on front outer edge sides of the operation box 7 are protruded, and the box cover 9 is mounted onto the operation box 7 by engaging the claw pieces 91 with the protruding portions 76.

Incidentally, a shift sometimes occurs in a relative positional relationship between the front panel 2 and the operation box 7 owing to accumulated errors of a positional shift of the operation box 7 to the hot water supply system body 1 and a positional shift of the front panel 2 to the hot water supply system body 1, which are caused by a positional shift of the mounting plate 8 and the like. When such a shift occurs, a gap between a periphery of the operation box 7 and the window 20 becomes nonuniform. Accordingly, the box cover 9 is formed to overhang to an outside of an outline of the operation box 7 and to have a size with which it is possible to cover the gap between the operation box 7 and the window 20 from the front. According to the above, the gap between the operation box 7 and the window 20 is hidden, does not appear on the exterior of the hot water supply system even if the gap becomes nonuniform, and does not accordingly damage the appearance thereof.

Figure 4:
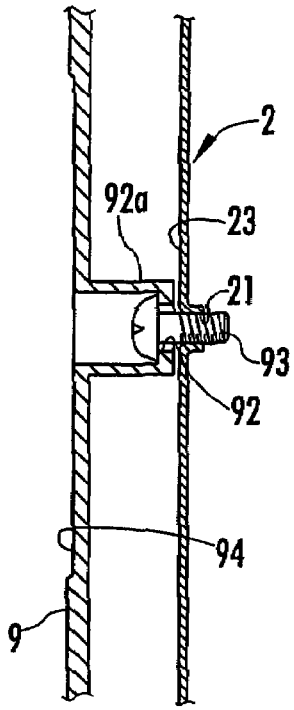
FIG. 4 is a cross-sectional view cut along a line IV-IV of FIG. 1.

Moreover, in this embodiment, the box cover 9 is formed into an oblong shape largely overhanging to one side in the horizontal direction of the operation box 7. In the overhanging portion of the box cover 9 to the one side in the horizontal direction, a pair of mounting holes 92 (refer to FIG. 4) are formed at an interval in the horizontal direction. Screws 93 inserted into the respective mounting holes 92 are screwed into the respective screw holes 21 formed in spots of the front panel 2, which correspond to the screws 93, and the box cover 9 is thus fastened to the front panel 2. Therefore, even if the engagement of the claw pieces 91 and the protruding portions 76 is released owing to vibrations during transportation and the like, the box cover 9 does not fall off. Note that, as shown in FIG. 4, each mounting hole 92 is formed in a bottom surface of a hollow boss portion 92*a* swelling to the backside of the box cover 9. Inner diameters of the boss portion 92*a* and the mounting hole 92 are formed larger than those of a head and screw of the screw 93, respectively, and the box cover 9 is thus able to be fastened to the front panel 2 even if the position of the box cover 9 is shifted owing to the positional shift of the operation box 7. Moreover, on a front surface of the overhanging portion of the box cover 9 to the one side in the horizontal direction, a shallow dent 94 is formed, and on the dent 94, a film or a plate (not shown) to which a mark such as a logotype is added is adhered, thereby allowing each screw 93 not to appear on the exterior. Furthermore, pin portions 95 are protruded on four corners of the back surface of the box cover 9, and holes 22 larger in diameter than the pin portions 95 are formed in spots of the front panel 2, which correspond to the pin portions 95. Each pin portion 95 is inserted into each hole 22, and rough positioning of the box cover 9 in the case of mounting the box cover 9 onto the operation box 7 is enabled.

Incidentally, a gap between the front panel 2 and the box cover 9 sometimes varies owing to a shift of the mounting position of the operation box 7 in the fore-and-aft direction. When the gap is visible from the vertical direction and the horizontal direction, the appearance is damaged. Accordingly, in this embodiment, a dent portion 23 with a size corresponding to that of the box cover 9 is formed on a portion of the front panel 2, which includes the spot where the window 20 is opened. Moreover, a backside corner portion 96 of an outer edge of the box cover 9 is adapted to enter into the dent portion 23. According to the above, the gap between the front panel 2 and the box cover 9 becomes invisible from both of the vertical direction and the horizontal direction, and the appearance is favorably maintained.

Figure 5:
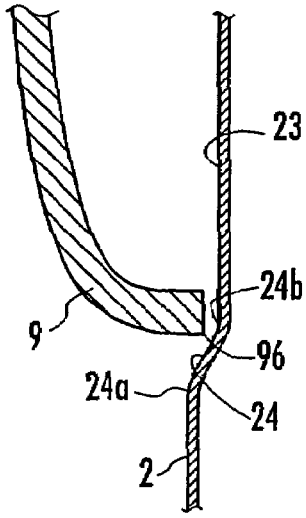
FIG. 5 is an enlarged cross-sectional view of a step portion of an outer edge of a dent portion of the front panel.

Moreover, in this embodiment, as explicitly shown in FIG. 5, a step portion of an outer edge of the dent portion 23 with respect to a portion of the front panel 2 in the periphery of the dent portion 23 is formed into an inclined surface 24 continuous to the above-described portion of the front panel 2 with a radially curved surface portion 24*a* interposed therebetween, and the inclined surface 24 is made continuous to a bottom surface of the dent portion 23 with a radially curved surface portion 24*b* interposed therebetween. Moreover, a position of the inclined surface 24 is set such that the backside corner portion 96 of the outer edge of the box cover 9 is opposite to a middle portion of the inclined surface 24 in a state where the operation box 7 is present in a normal position with respect to the front panel 2. Note that the backside corner portion 96 of the outer edge of the box cover 9 is opposite to the middle portion of the inclined surface 24 separately therefrom with a gap so as to make it possible to absorb the shift of the box cover 9 owing to the positional shift of the operation box 7.

According to the above, unlike the case where the step portion of the outer edge of the dent portion 23 is formed to create a reentrant from the front panel 2 at a right angle, the outer edge (outline) of the dent portion 23 cannot be clearly seen. Therefore, even if a gap between a periphery of the box cover 9 and the outer edge of the dent portion 23 becomes nonuniform owing to the shift of the mounting position of the operation box 7, such nonuniformity of the gap becomes inconspicuous. Moreover, the shift is conspicuous when the outer edge of the box cover 9 shifts inward from the inclined surface 24, and the bottom surface of the dent portion 23 appears on the exterior. However, in this embodiment, the backside corner portion 96 of the outer edge of the box cover 9 is located at the middle portion of the inclined surface 24. Accordingly, even if the box cover 9 positionally shifts to some extent, the bottom surface of the dent portion 23 does not appear on the exterior, and the appearance can be favorably maintained. Furthermore, it is possible to omit the curved surface portion 24*b* on the bottom surface side of the inclined surface 24. However, if the curved surface portion 24*b* is formed, a boundary between the bottom surface of the dent portion 23 and the inclined surface 24 cannot be clearly seen. Accordingly, the curved surface portion 24*b* is useful for preventing deterioration of the appearance in the case where the box cover 9 positionally shifts to an extent where the bottom surface of the dent portion 23 appears on the exterior.

Note that, though the box cover 9 is formed into the oblong shape largely overhanging to the one side in the horizontal direction of the operation box 7 in the above-described embodiment, the present invention is not limited to this, and the size and shape of the box cover 9 can be arbitrarily set as long as the size and the shape meet the condition to cover the gap between the operation box 7 and the window 20.

What is claimed is:

1. A hot water supply system, comprising:

a hot water supply system body;

a window opened in a front panel of the hot water supply system body;

an operation box having at least a front side and a rear side mounted onto the hot water supply system body and inserted into the window;

a box cover having an opening and mounted onto a front surface of the operation box; and an operation unit provided on a front center region of the operation box and fitted into the opening;

wherein the box cover is formed to overhang to an outside of an outline of the operation box and to have a size with which it is possible to cover a gap between the operation box and the window from the front, and a dent portion with a size corresponding to a size of the box cover is formed on a portion of the front panel, the portion including a spot where the window is opened, and a backside corner portion of an outer edge of the box cover enters into the dent portion, wherein a step portion of an outer edge of the dent portion with respect to a portion of the front panel in a periphery of the dent portion is formed into an inclined surface continuous to the portion of the front panel with a radially curved surface portion interposed therebetween.

2. The hot water supply system according to claim 1, wherein the backside corner portion of the outer edge of the box cover is opposite to a middle portion of the inclined surface.

3. The hot water supply system according to claim 2, wherein the inclined surface is continuous to a bottom surface of the dent portion with a radially curved surface portion interposed therebetween.

* * * * *